US009655444B2

(12) United States Patent
Watts

(10) Patent No.: US 9,655,444 B2
(45) **Date of Patent: *May 23, 2017**

(54) CONVERTIBLE WALL HANGING TABLE

(71) Applicant: Mark Watts, Doylestown, PA (US)

(72) Inventor: Mark Watts, Doylestown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/082,770

(22) Filed: Mar. 28, 2016

(65) Prior Publication Data

US 2016/0255955 A1 Sep. 8, 2016

Related U.S. Application Data

(63) Continuation of application No. 14/640,271, filed on Mar. 6, 2015, now Pat. No. 9,295,323.

(60) Provisional application No. 61/950,629, filed on Mar. 10, 2014.

(51) Int. Cl.

| | |
|---|---|
| ***A47B 3/00*** | (2006.01) |
| ***A47B 85/06*** | (2006.01) |
| ***A47B 3/08*** | (2006.01) |
| ***A47B 13/12*** | (2006.01) |
| ***A47B 97/00*** | (2006.01) |
| ***H05K 5/00*** | (2006.01) |

(52) U.S. Cl.

CPC ..... *A47B 85/06* (2013.01); *A47B 3/08* (2013.01); *A47B 3/0803* (2013.01); *A47B 3/0818* (2013.01); *A47B 13/12* (2013.01); *A47B 97/001* (2013.01); *H05K 5/0017* (2013.01)

(58) Field of Classification Search

CPC ..... A47B 35/00; A47B 13/08; A47B 13/081; A47B 13/083; A47B 13/086; A47B 13/12; A47B 3/06; A47B 3/08; A47B 3/0809; A47B 3/0818; A47B 2003/0827

USPC .... 108/13, 11, 19, 27, 132, 90, 50.01, 50.02

See application file for complete search history.

(56) References Cited

U.S. PATENT DOCUMENTS

| | | | | | |
|---|---|---|---|---|---|
| 326,112 | A * | 9/1885 | Gray | A47B 3/0912 | 108/132 |
| 1,381,588 | A * | 6/1921 | Norwood | A47B 3/0818 | 108/132 |
| 1,709,927 | A * | 4/1929 | Whitney | A47B 3/0815 | 108/132 |
| 1,859,588 | A * | 5/1932 | Kehrer | A47B 3/0916 | 108/132 |
| 2,508,627 | A * | 5/1950 | Spiegel | A47B 3/0912 | 108/19 |
| 2,688,524 | A * | 9/1954 | Hodgman | A47B 1/04 | 108/19 |
| 3,087,442 | A * | 4/1963 | Berliner | A47B 9/18 | 108/19 |

(Continued)

*Primary Examiner* — Jose V Chen

(74) *Attorney, Agent, or Firm* — Duane Morris LLP

(57) ABSTRACT

A convertible art table configured to be hung as wall art and to convert to an art topped table comprises a frame having one or more members defining an inner volume. A digital display configured to display one or more pieces of artwork is located within the inner volume. One or more legs are rotatably coupled to the frame. The legs are selectively rotatable from a collapsed position to a deployed position. In the collapsed position, the legs are flush with the frame such that the frame can be hung on a wall. In the deployed position, the legs support the frame such that the artwork defines a longitudinal surface usable as a table or desk.

20 Claims, 13 Drawing Sheets

(56) References Cited

U.S. PATENT DOCUMENTS 3,554,140 A * 1/1971 Homesberger ..... A47B 13/08 108/161
3,783,799 A * 1/1974 Dupuis ..... A47B 3/083 108/19
3,802,708 A * 4/1974 Libert ..... A63F 3/00643 108/23
4,237,795 A * 12/1980 Parker ..... A47B 9/00 108/12
4,821,651 A * 4/1989 Peng ..... A47B 13/08 108/90
4,841,878 A * 6/1989 Kriegsman ..... A47B 13/12 108/62
5,697,305 A * 12/1997 Chasan ..... A47B 13/12 108/27
6,123,031 A * 9/2000 Hayman-Chaffey .. A47B 13/08 108/157.1
6,367,392 B2 * 4/2002 Moore ..... G09F 23/00 108/27
6,658,677 B2 * 12/2003 Paul ..... A47C 19/022 16/417
6,739,271 B1 * 5/2004 Hancock ..... A47B 13/12 108/27
7,387,151 B1 * 6/2008 Payne ..... E06B 5/006 160/371
7,658,388 B1 * 2/2010 Rodriguez ..... B62B 3/027 108/131
7,730,841 B2 * 6/2010 Wang ..... A47B 13/12 108/153.1
8,381,661 B2 * 2/2013 Hilde ..... A47B 43/00 108/42
9,295,323 B2 * 3/2016 Watts ..... A47B 3/0818
2004/0016372 A1 * 1/2004 Johnson ..... A47B 1/08 108/11
2015/0201751 A1 * 7/2015 Gu ..... A47B 85/06 108/11

* cited by examiner

CONVERTIBLE WALL HANGING TABLE

CROSS-REFERENCE TO RELATED APPLICATIONS

This application is a continuation of co-pending U.S. patent application Ser. No. 14/640,271, filed on Mar. 6, 2015, entitled "TABLE—ART," which claimed benefit under 35 U.S.C. §119(e) to U.S. Provisional Patent Application Ser. No. 61/950,629, filed on Mar. 10, 2014, entitled "Mark Watts—Table—Att," each of which are incorporated herein by reference in their entirety.

BACKGROUND

In many urban and suburban areas, living and working space is a premium. Limited floor space in apartments, homes, shared work spaces, and other living spaces can make it difficult to properly furnish a space for one or more desired purposes. Trade-offs are often required between considerations such as necessary open space, for example due to fire codes, building codes, and/or personal preference, and providing adequate fixtures for enabling use of the space, such as, for example, tables or desks to allow comfortable working, entertaining, and living.

Even in environments having limited floor space, wall space is generally available. Wall space can be utilized for decorating an environment, such as, for example, by hanging artwork or other hangings. The selected artwork can reflect the tastes of the owners, the function of the space, and/or may be based on one or more additional aesthetic or functional considerations. It would be desirable to utilize the available wall space in limited floor space environments to serve dual functional and artistic purposes.

SUMMARY

In various embodiments, a convertible art table is disclosed. The convertible art table comprises a frame, a digital display screen, and at least a first leg member rotatably coupled to the frame. The frame comprises a first longitudinal member, a second longitudinal member, a first transverse member coupled to a first side of the first longitudinal member and a first side of the second longitudinal member, and a second transverse member coupled to a second side of the first longitudinal member and a second side of the second longitudinal member. The first longitudinal member, the second longitudinal member, and the first transverse member define an inner volume. The digital display screen is located within the inner volume. The at least first leg is rotatable from a first position in which the at least first leg member is flush with the frame to a second position. The at least first leg member is transverse to the frame in the second position.

In various embodiments, a system is disclosed. The system comprises a convertible art table and a digital display screen. The convertible art table comprises a frame and at least a first leg member rotatably coupled to the frame. The frame comprises a first longitudinal member, a second longitudinal member, a first transverse member coupled to a first side of the first longitudinal member and a first side of the second longitudinal member, and a second transverse member coupled to a second side of the first longitudinal member and a second side of the second longitudinal member. The first longitudinal member, the second longitudinal member, and the first transverse member define an inner volume. The at least first leg is rotatable from a first position in which the at least first leg member is flush with the frame to a second position. The at least first leg member is transverse to the frame in the second position. A wireless communication module is in signal communication with the digital display. The wireless communication module is configured to receive one or more digital images from a remote subscription service. The one or more digital images are displayed on the digital display.

In various embodiments, a convertible art table is disclosed. The convertible art table comprises a frame, a digital display, a first leg member, and a second leg member. The frame comprises a first longitudinal member, a second longitudinal member, a first transverse member coupled to a first side of the first longitudinal member and a first side of the second longitudinal member, and a second transverse member coupled to a second side of the first longitudinal member and a second side of the second longitudinal member. The first longitudinal member, the second longitudinal member, and the first transverse member define an inner volume. The digital display is located within the inner volume. The first and second legs are rotatably coupled to the frame. The first and second legs are rotatable from a first position in which the first and second leg members are flush with the frame to a second position. The first and second leg members are transverse to the frame in the second position.

BRIEF DESCRIPTION OF THE FIGURES

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
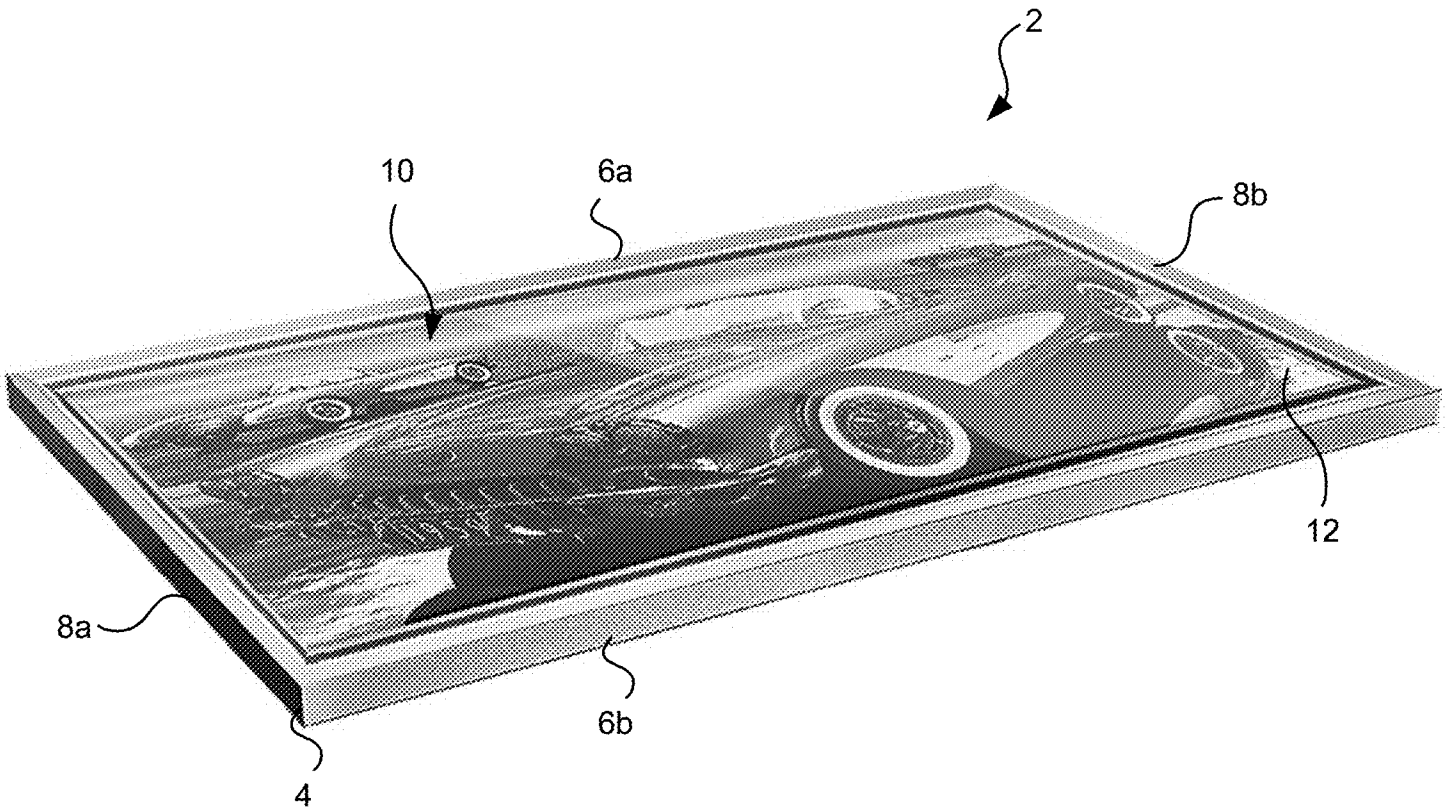
FIG. 1 illustrates a perspective view of one embodiment of a convertible art table in a collapsed configuration.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral," "proximal" versus "distal" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively coupled" is such an attachment, coupling, or connection that allows the pertinent structures to operate as intended by virtue of that relationship. In the claims, means-plus-function clauses, if used, are intended to cover structures described, suggested, or rendered obvious by the written description or drawings for performing the recited function, including not only structure equivalents but also equivalent structures.

In various embodiments, a convertible art table is disclosed. The convertible art table generally comprises a frame having one or more members defining an inner volume. One or more pieces of artwork are located within the inner volume. One or more legs are rotatably coupled to the frame. The legs are selectively rotatable from a collapsed position to a deployed position. In the collapsed position, the legs are flush with the frame such that the frame can be hung on a wall. In the deployed position, the legs support the frame such that the artwork defines a longitudinal surface usable as a table or desk.

FIGS. 1-6 illustrate one embodiment of a convertible art table 2. FIG. 1 illustrates the convertible art table 2 in a collapsed position. The convertible art table 2 comprises a frame 4. The frame 4 defines an outer perimeter of the convertible art table 2 and an inner volume. In some embodiments, the frame 4 comprises a rectangular shape, although it will be appreciated that the convertible art table 2 can comprise any suitable shape, such as, for example, a circular shape, a square shape, a regular geometric shape, and/or any other shape. In the illustrated embodiment, the frame 4 is a rectangular frame having a first longitudinal member 6*a* and a second longitudinal member 6*b* coupled by a first cross-member 8*a* and a second cross-member 8*b*. The longitudinal members 6*a*, 6*b* and the cross-members 8*a*, 8*b* meet at a predetermined angle. The predetermined angle may be, for example, a 90 degree angle, a 45 degree angle, and/or any other suitable angle. The longitudinal members 6*a*, 6*b* and the cross-members 8*a*, 8*b* define an inner volume. The longitudinal members 6*a*, 6*b* and/or the cross-members 8*a*, 8*b* may comprise any suitable material, such as, for example, metal (for example extruded aluminum), wood, plastic, and/or any other suitable material.

In some embodiments, the convertible art table 2 includes artwork 10 located within the inner volume. The artwork 10 may comprise any suitable art piece, such as, for example, a painting, a photograph, and/or any other artwork suitable for framing. In some embodiments, the artwork 10 is replaced with a digital display, such as, for example, an LCD, LED, OLED, and/or any other suitable digital display. In some embodiments, the artwork 10 may be replaced by a game board, such as, for example, a game board, a replica field, and/or any other game board.

In some embodiments, the artwork 10 is covered by a protective covering 12, such as, for example, a glass pane, a plastic pane, a Plexiglas plane, a lacquer coating, and/or any other suitable protective covering. The protective covering 12 is configured to protect the artwork from moisture, dust, wear and tear, and/or other harmful environmental factors. In some embodiments, a sealant is applied between the protective covering 12 and the frame 4 to further protect the artwork 10.

In some embodiments, the internal surfaces of the frame 4 define longitudinal channels sized and configured to receive the artwork 10 and/or the protective covering 12 therein. The longitudinal channels may define recessed channels formed in the longitudinal members 6*a*, 6*b* and/or the cross-members 8*a*, 8*b* of the frame 4. In some embodiments, the longitudinal members 6*a*, 6*b* and/or the cross-members 8*a*, 8*b* define an upper lip surface. The protective covering 12 and/or the artwork 10 are sized and configured to rest on the upper lip surface. The protective covering 12 is sealed to the frame 4 to maintain the protective covering 12 and the artwork 10 in a fixed position with respect to the frame 4. Although the embodiments described herein include separate artwork and frame, it will be understood that in some embodiments, the artwork 10 and the frame 4 may comprise a single unitary piece.

Figure 2:
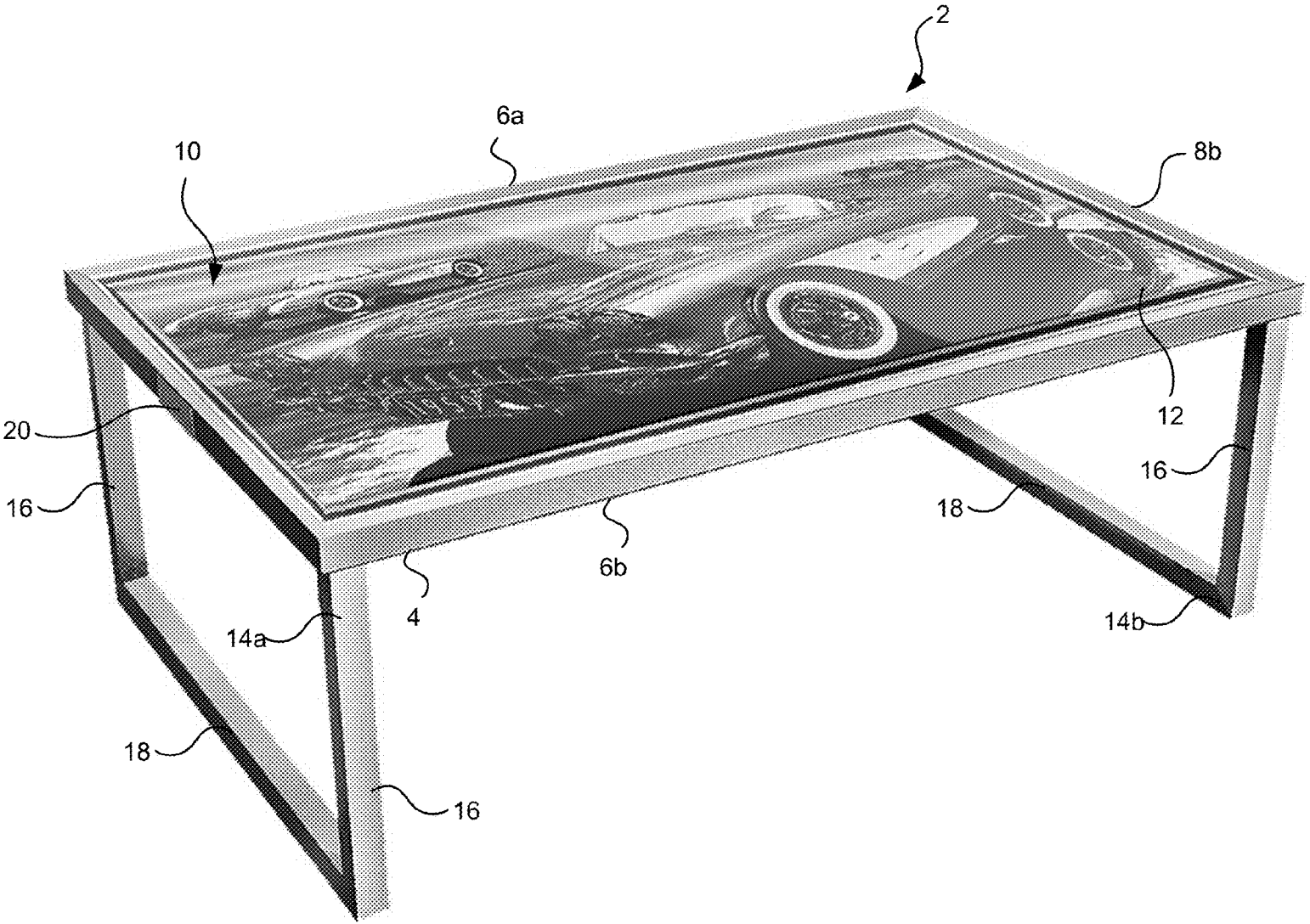
FIG. 2 illustrates the convertible art table of FIG. 1 in an expanded configuration.

In some embodiments, the convertible art table 2 is convertible from a collapsed configuration suitable for hanging on a wall (as shown in FIG. 1) to an expanded configuration that allows the convertible art table 2 to be used as a table (as shown in FIG. 2). The convertible art table 2 comprises one or more legs 14*a*, 14*b* rotatably coupled to the frame 4. Each of the legs 14*a*, 14*b* includes a plurality of leg members 16, a bottom cross-member 18, and a top cross-member 26 (see FIG. 3). The legs are rotatable from a first, collapsed position to a second, deployed position. To convert the convertible art table 2 to a table, a first leg 14*a* and a second leg 14*b* are deployed from the collapsed position to the deployed position. The first leg 14*a* and the second leg 14*b* are rotatably coupled to the frame 4, for example, by a hinge, joint, or other rotatable coupling. The first and second legs 14*a*, 14*b* are deployed by rotating the legs 14*a*, 14*b* about an axis of rotation defined between the top cross-member 26 of each of the legs 14*a*, 14*b* and the frame 4 (see FIG. 3).

In some embodiments, the first and second legs 14*a*, 14*b* are locked after deployment by a locking mechanism. In the illustrated embodiment, each of the first and second legs 14*a*, 14*b* are locked to the frame 4 by a removable locking member 20. The locking member 20 comprises a locking clip sized and configured to couple the first and second legs 14*a*, 14*b* to the frame 4 when the first and second legs 14*a*, 14*b* are in a deployed position. The locking clip comprises a u-shaped clip. In other embodiments, the first and second legs 14*a*, 14*b* may be locked to the frame 4 by a locking tab, locking bolt, and/or any other suitable locking mechanism. The locking mechanism may be an external locking mechanism (as illustrated) and/or may comprise an internal locking mechanism.

Figure 3:
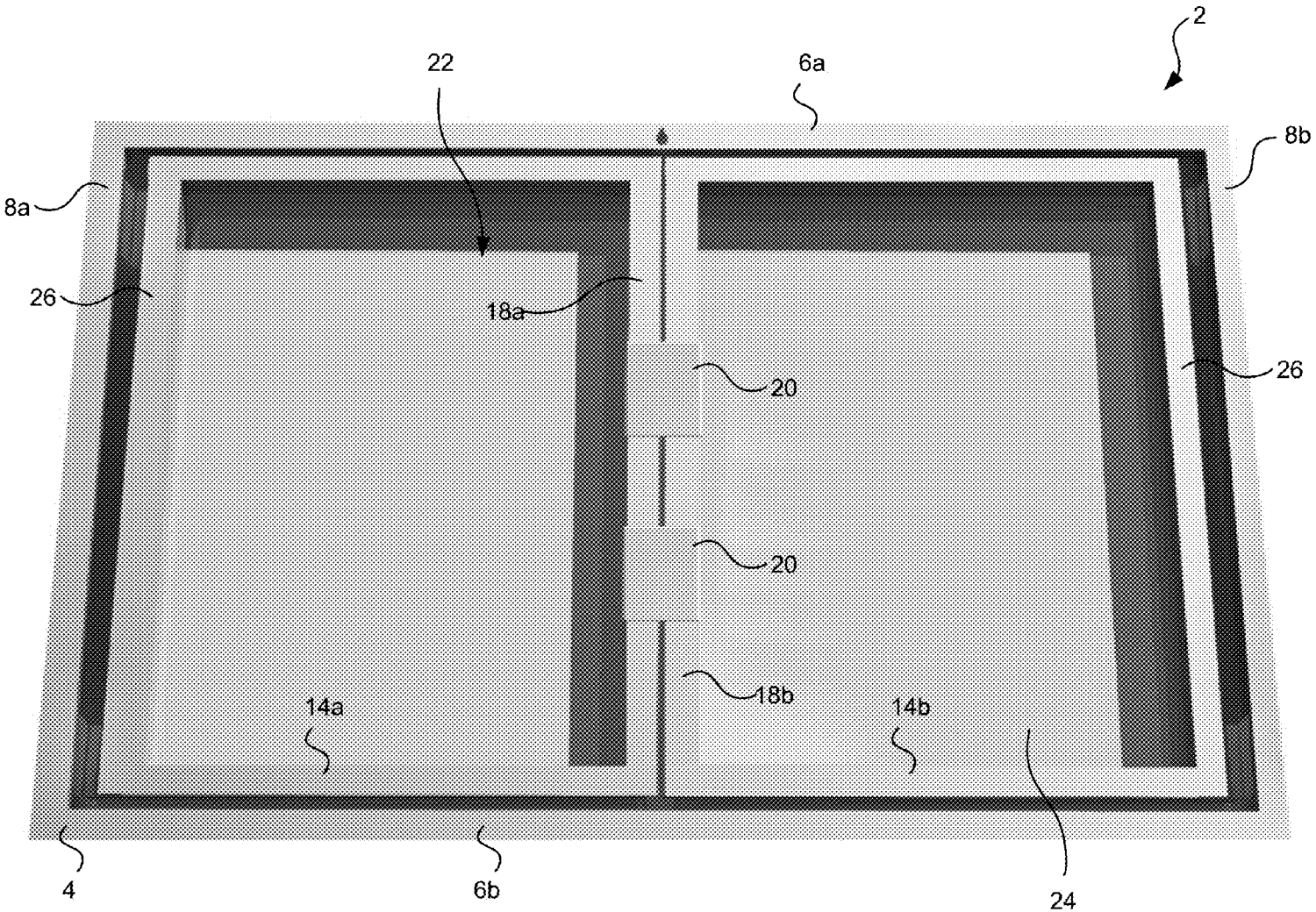
FIG. 3 illustrates a bottom view of the convertible art table of FIG. 1 with the legs in a collapsed position.

FIG. 3 illustrates a back surface 24 of the convertible art table 2. The frame 4 defines an internal volume 22. The walls of the internal volume 22 are defined by, for example, the longitudinal members 6*a*, 6*b* and the cross-members 8*a*, 8*b* of the frame 4. In some embodiments, the internal volume 22 comprises a depth at least equal to a thickness of the first and second legs 14*a*, 14*b*. When the first and second legs 14*a*, 14*b* are in a collapsed position, the first and second legs 14*a*, 14*b* sit flush with and/or recessed beneath the frame 4, which allows the convertible art table 2 to hang flush on a wall.

In some embodiments, the first and second legs 14*a*, 14*b* may be locked in a collapsed position to prevent accidental deployment. In the illustrated embodiment, the first and second legs 14*a*, 14*b* are locked in the collapsed position by one or more locking members 20. The locking members 20 couple the respective bottom cross-members 18*a*, 18*b* of the first and second legs 14*a*, 14*b*. The locking members 20 are removed to allow the first and second legs 14*a*, 14*b* to transition to a deployed position. After the legs 14*a*, 14*b* are transitioned to a deployed position, the locking members 20 may be used to lock the legs 14*a*, 14*b* in a deployed position.

Figure 4:
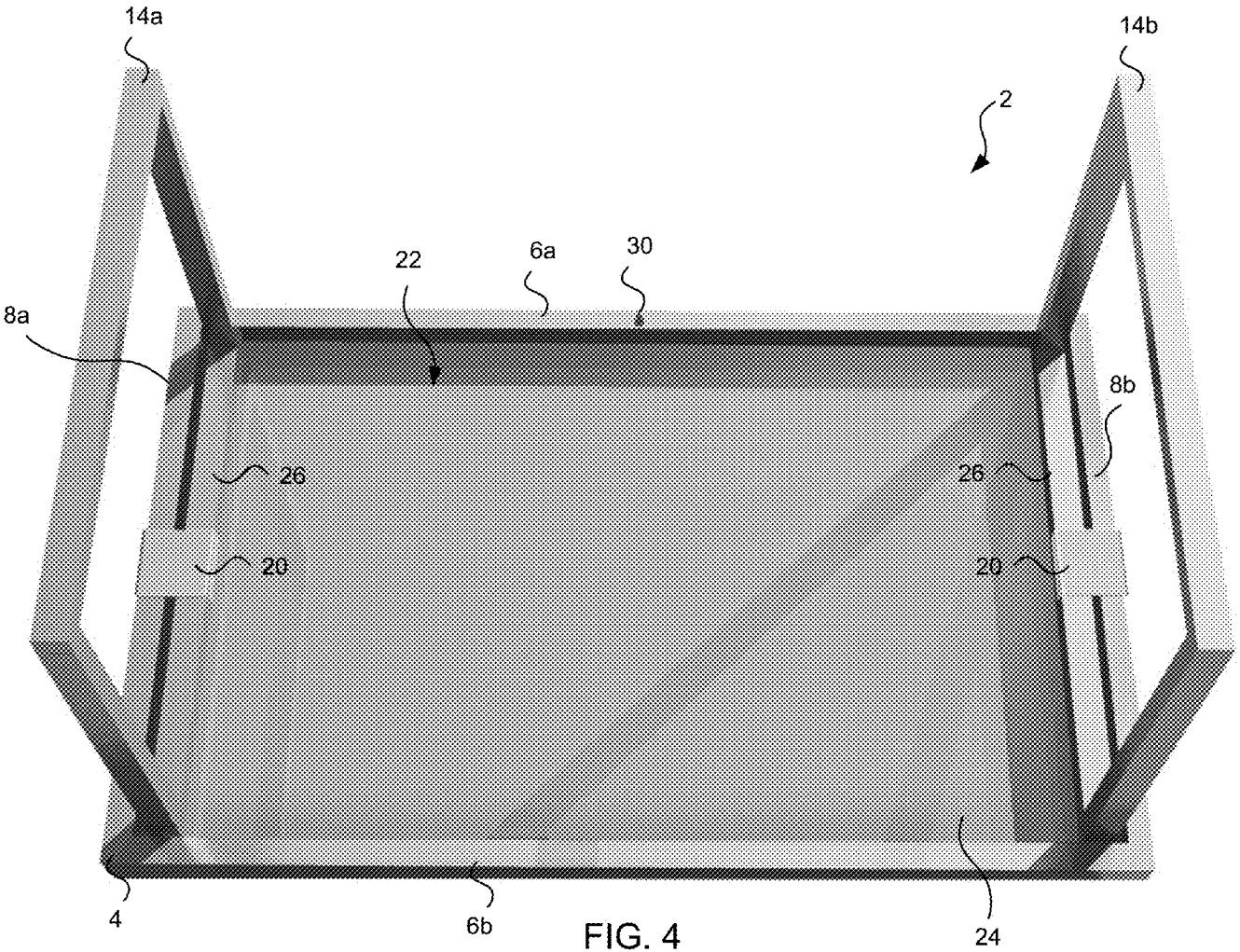
FIG. 4 illustrates a bottom view of the convertible art table of FIG. 1 with the legs in an expanded position.
Figure 5:
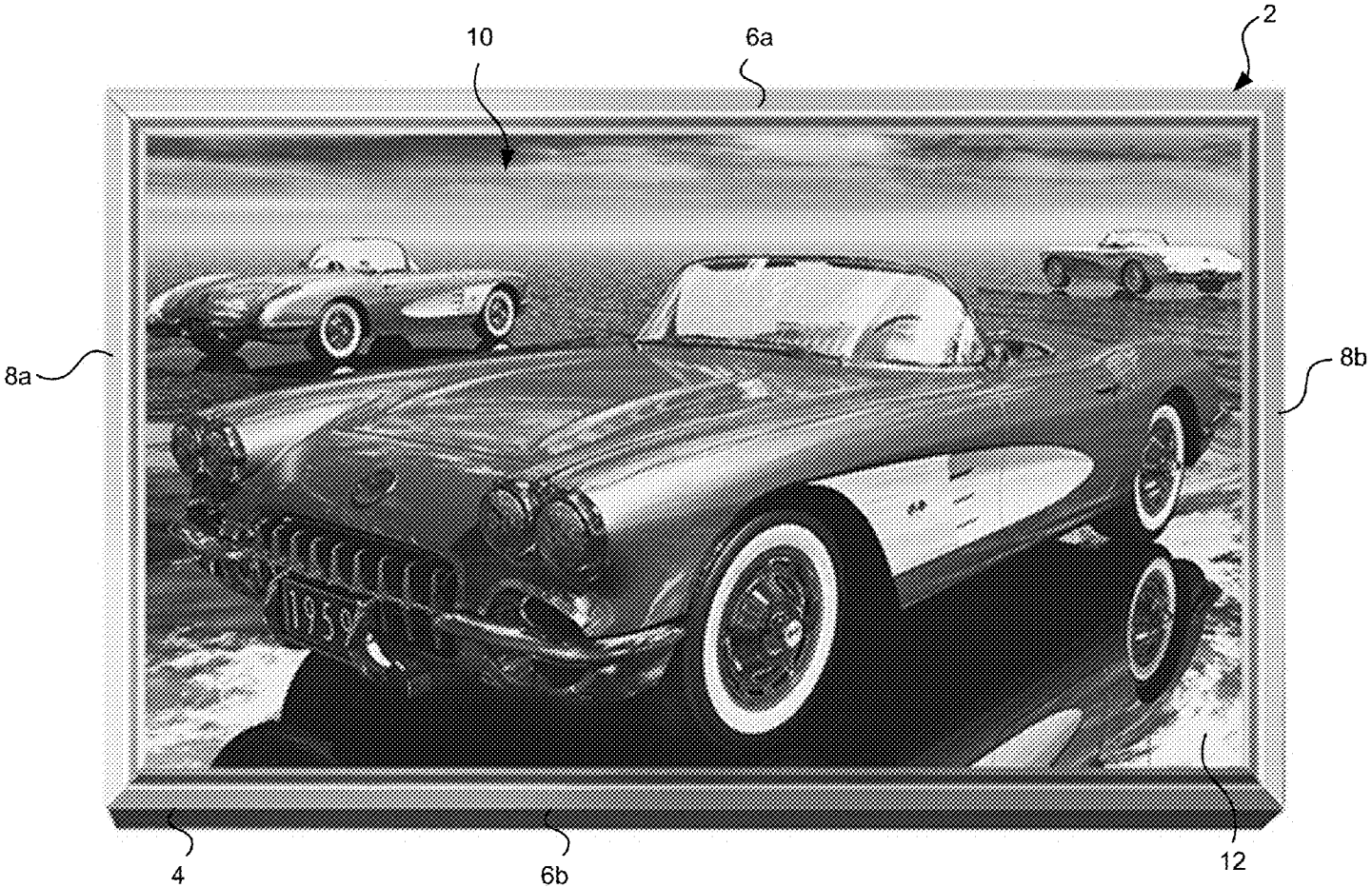
FIG. 5 illustrates a top view of the convertible art table of FIG. 1 having the side frame piece coupled thereto.
Figure 6:
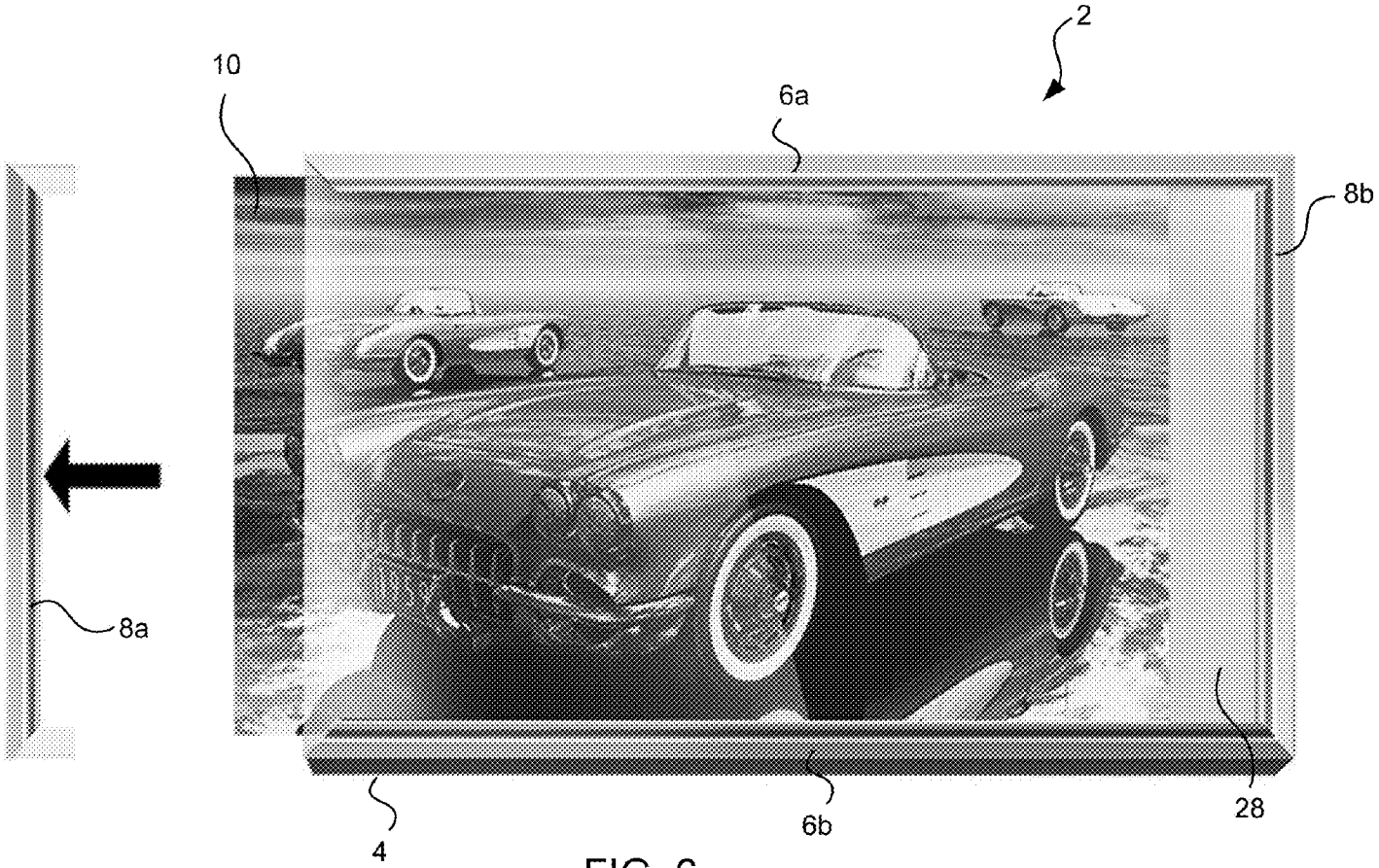
FIG. 6 illustrates a top view of the convertible art table of FIG. 1 having a side frame piece removed therefrom.

FIG. 4 illustrates the back surface 24 of the convertible art table 2 with first and second legs 14*a*, 14*b* in a deployed position. The top cross-member 26 of each of the first and second legs 14*a*, 14*b* rotates within the inner volume 22, such that the top cross-member 26 remains flush with the frame 4 in a deployed position. In some embodiments, the top cross-member 26 of each of the first and second legs 14*a*, 14*b* is rotatably coupled to respective cross-members 8*a*, 8*b* of the frame 4.

In some embodiments, the first and second legs 14*a*, 14*b* are locked and/or fixed to the frame 4 when in a deployed position. The first and second legs 14*a*, 14*b* may be locked to the frame 4 by, for example, locking members 20. The locking members 20 couple the upper cross-member 26 of each of the first and second legs 14*a*, 14*b* to respective frame cross-members 8*a*, 8*b*. In operation, the locking members 20 are removed from the bottom cross-members 18*a*, 18*b* of the first and second legs 14*a*, 14*b*. The first and second legs 14*a*, 14*b* are transitioned to a deployed position (as shown in FIG. 4). The locking members 20 are coupled to the upper cross-members 26 and frame cross-members 8*a*, 8*b* to lock the legs 14*a*, 14*b* in the deployed position.

In some embodiments, the convertible art table 2 comprises changeable artwork 10. For example, in some embodiments, one or more pieces of the frame 4, such as, for example, a first cross-member 8*a*, are removable (see FIGS. 5 & 6). The removable cross-member 8*a* is separated from the first and second longitudinal members 6*a*, 6*b*. Once the removable cross-member 8*a* is removed, the artwork 10 may be removed from the frame 4 and replaced with an second piece. In some embodiments, a hard backing 28 remains in the frame 4 after the artwork 10 is removed. In some embodiments, the backing 28 is removable. The removable cross-member 8*a* may be coupled to the longitudinal members 6*a*, 6*b* by one or more projections that form a friction coupling within an internal channel defined by the longitudinal members 6*a*, 6*b*. In some embodiments, one or more fasteners may be used to couple the removable cross-member 8*a* to the longitudinal members 6*a*, 6*b*. The one or more fasteners may comprise any suitable fastener, such as, for example, a screw, bolt, detent pins, and/or any other removable fastener.

In some embodiments, the removable artwork 10 and/or the removable backing 28 are disposed within longitudinal slots defined by the inner surface of the frame 4. For example, one embodiment, the longitudinal members 6*a*, 6*b* and the cross-members 8*a*, 8*b* define longitudinal slots formed therein. The longitudinal slots are sized and configured to receive the artwork 10, the protective cover 12, and/or the backing 28. In some embodiments, the longitudinal slots are sized and configured to receive multiple pieces of artwork 10, to provide for simple interchanging of artwork 10. For example, in one embodiment, two or more pieces of artwork 10, such as, for example, art pieces, photos, game table art, game boards, and/or any other suitable artwork are stored in the frame 4. The removable cross-member 8*a* can be removed from the frame 4 and the pieces of artwork 10 stored within the frame can be rearranged such that a new piece of artwork 10 is displayed by the frame 4. For example, in some embodiments, up to five or more art pieces, photos, game tables, game boards, etc., are stored in the frame 4.

In operation, the convertible art table 2 is configured to be stored and displayed on a wall as an art piece (see FIG. 1). The convertible art table 2 can be removed from the wall and converted into a table (see FIG. 2) as needed. For example, in small apartments, dorm rooms, and/or other living areas with limited space, the convertible art table 2 can be displayed on the wall as artwork when not in use, saving floor space. When a table is required, for example, as a working space, for entertaining, as a play area for children, etc., the convertible art table 2 is removed from the wall, converted into a table, and can be used as a table for any duration. The convertible art table 2 can be converted back into the collapsed position and placed back onto a wall when no longer needed.

In some embodiments, at least one of the longitudinal members 6*a*, 6*b* and/or the cross-members 8*a*, 8*b* of the frame 4 define a wall hanging feature 30. The wall hanging feature 30 may comprise any suitable wall hanging device. For example, in the illustrated embodiment, the wall hanging feature 30 comprises a hole formed in the first longitudinal member 6*a*. A fastener, such as, for example, a screw, is coupled to a wall. The fastener is configured to interface with the wall hanging feature 30. In other embodiments, the wall hanging feature 30 may comprise any other suitable wall hanging device, such as, for example, a wire, a hook, etc. Although the illustrated embodiments include a wall hanging feature 30 formed in the first longitudinal member 6*a*, it will be appreciated that the wall hanging feature 30 may be formed in any suitable portion of the convertible art table 2, such as, for example, the first or second longitudinal members 6*a*, 6*b*, the first or second cross-members 8*a*, 8*b*, the backing 28, and/or any other suitable portion of the convertible art table 2. In some embodiments, multiple wall hanging features 30 may be formed in the convertible art table 2 to allow the convertible art table 2 to be hung in a plurality of orientations.

Figure 7:
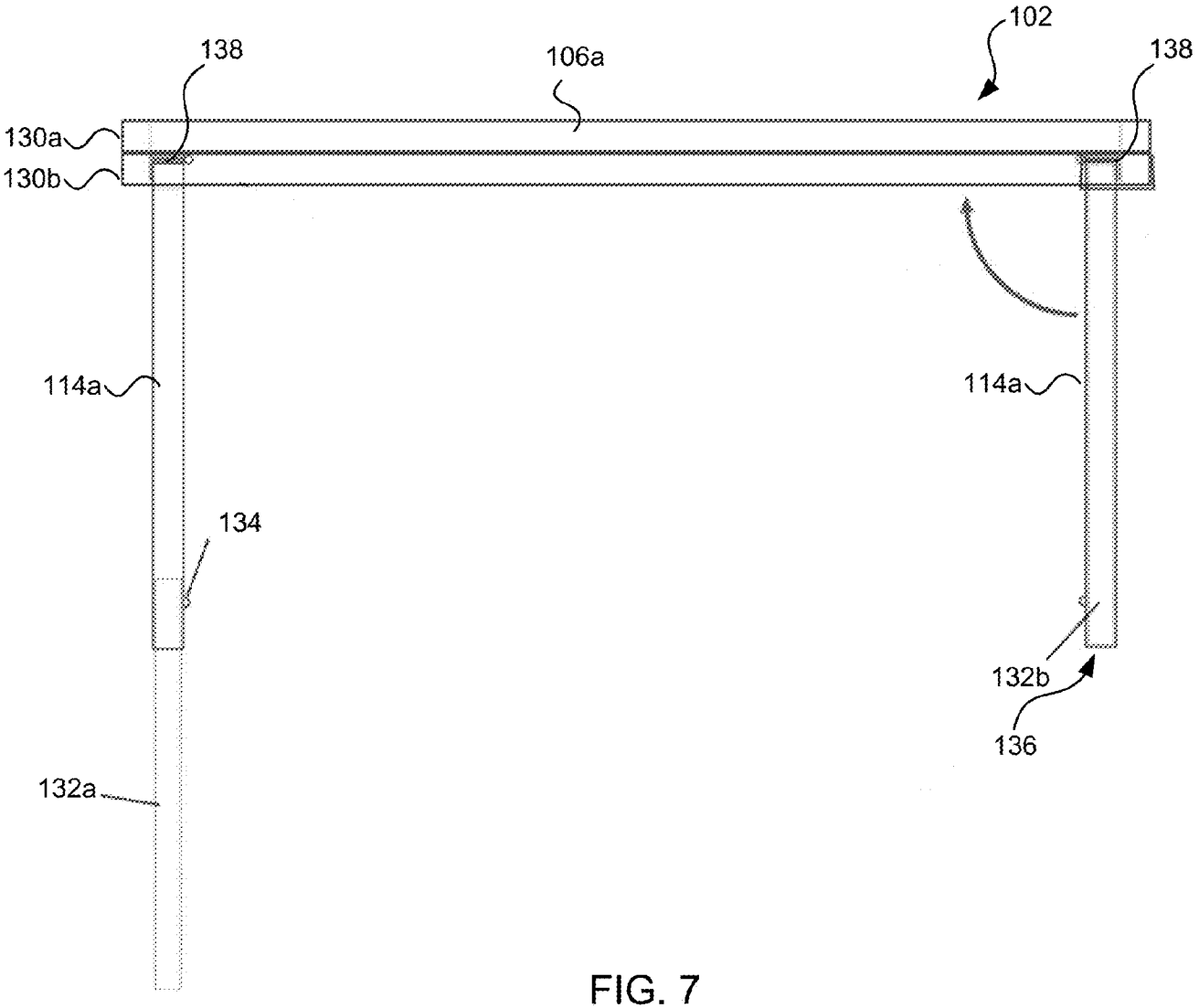
FIG. 7 illustrates a front view of one embodiment of a convertible art table.
Figure 8:
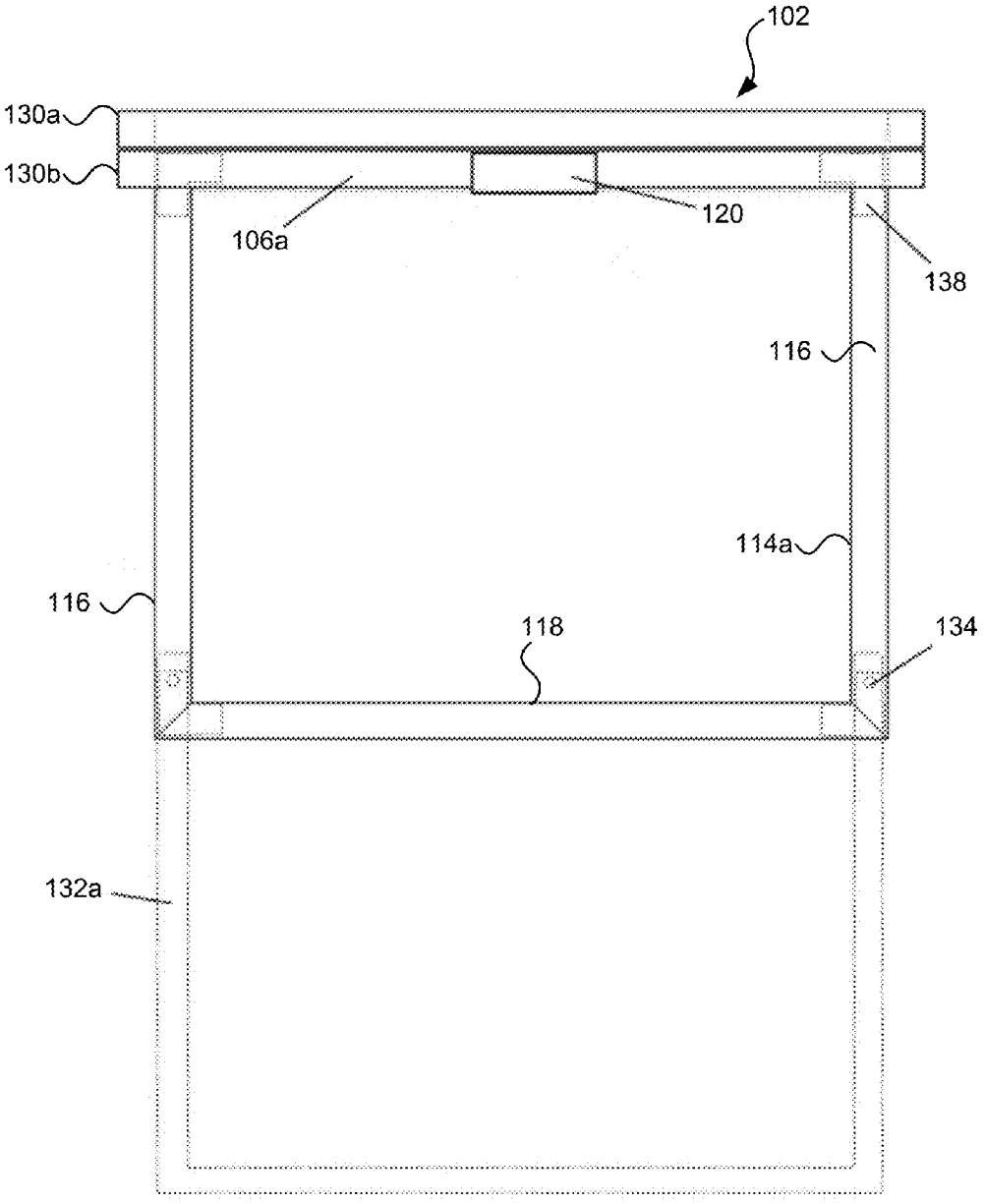
FIG. 8 illustrates a side view of the convertible art table of FIG. 7.
Figure 9:
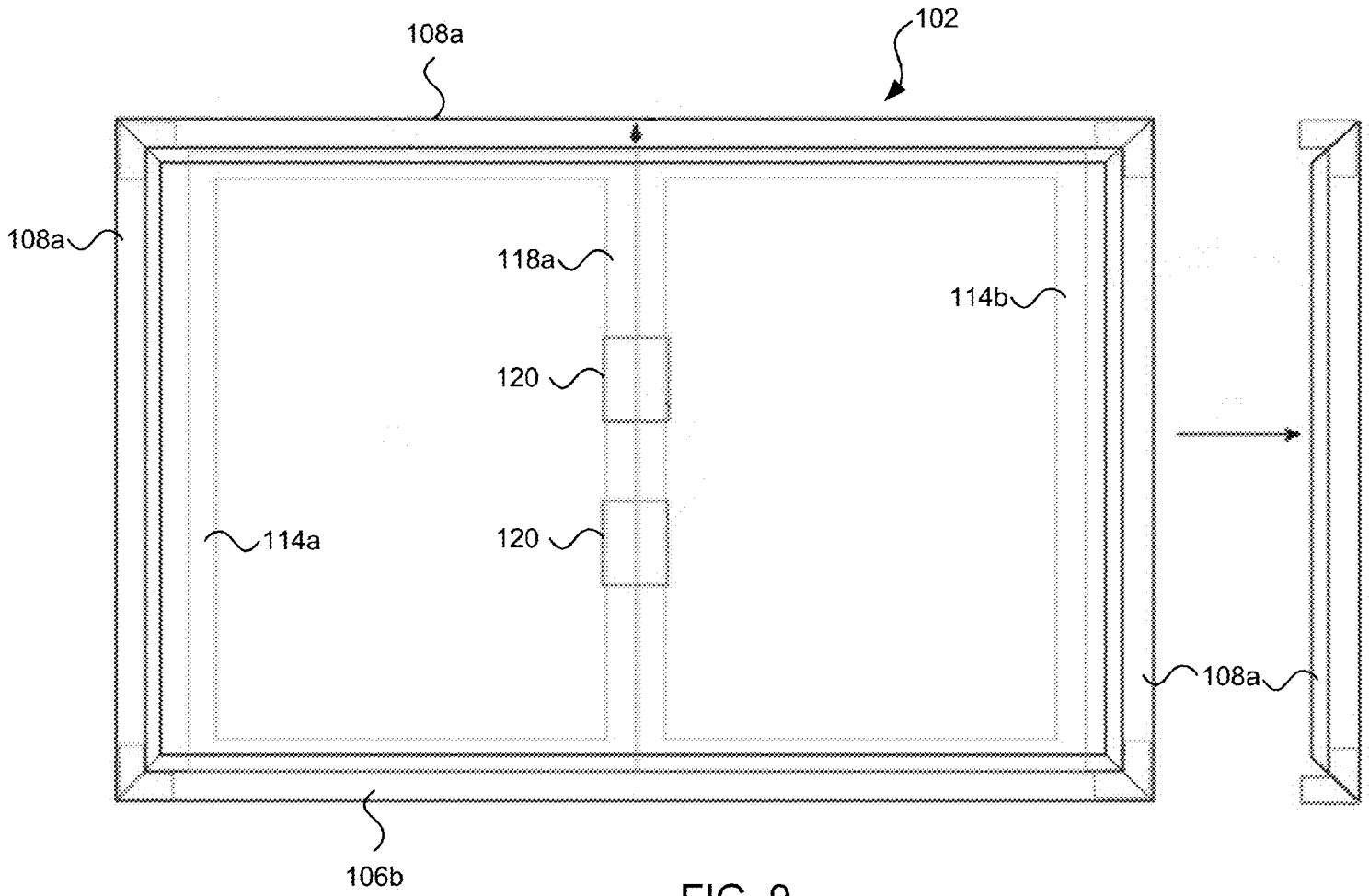
FIG. 9 illustrates a top view the art table of FIG. 7 in a collapsed position having the legs shown in phantom.
Figure 11:
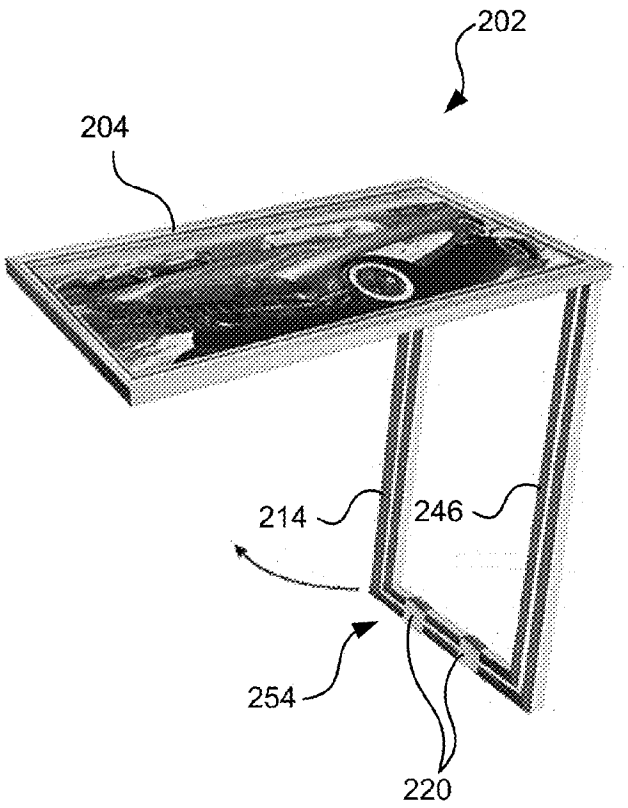
FIG. 11 illustrates the convertible art table of FIG. 10 having a base member folded into a leg member.
Figure 10:
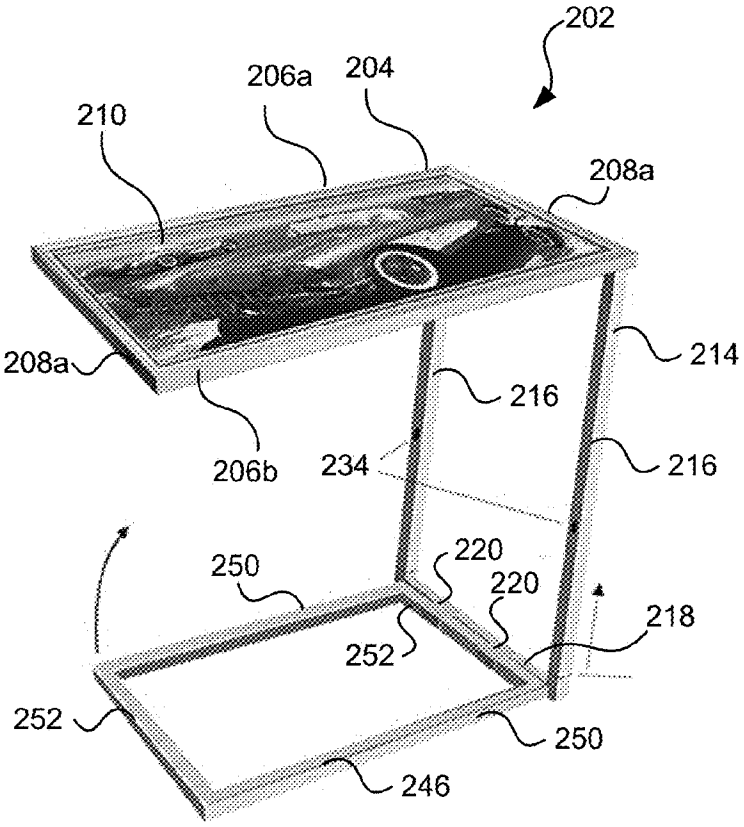
FIG. 10 illustrates one embodiment of a convertible art table including a single leg.
Figure 12:
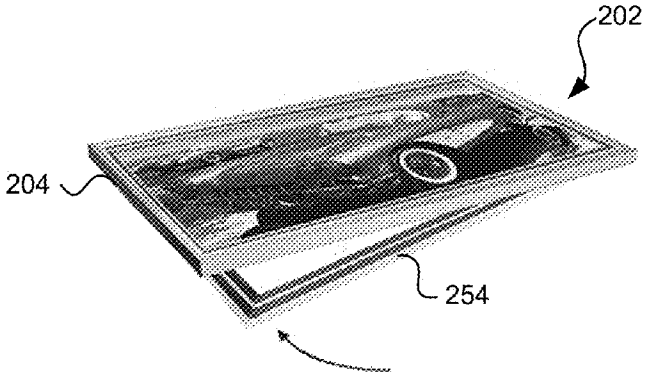
FIG. 12 illustrates the convertible art table of FIG. 10 having a combined base member and leg member partially collapsed into a frame.
Figure 13:
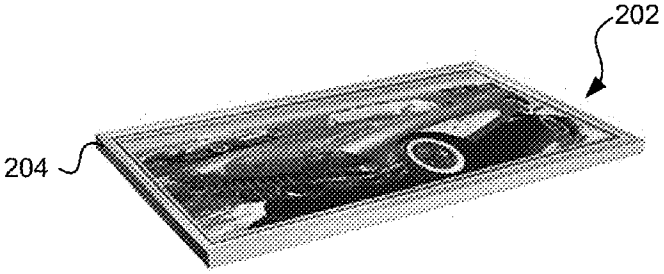
FIG. 13 illustrates the convertible art table of FIG. 10 having the base member and leg member in a fully collapsed position.
Figure 14:
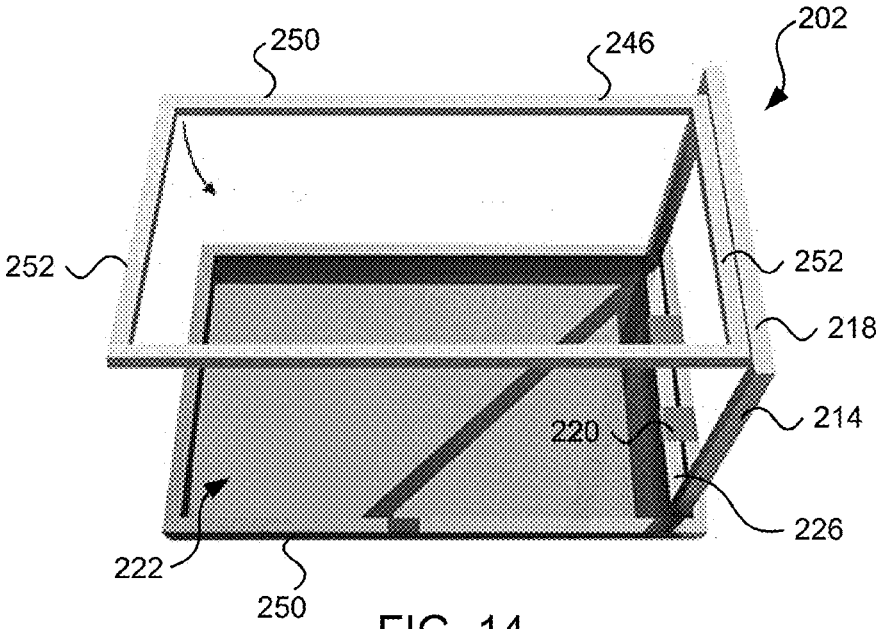
FIG. 14 illustrates a rear view of the convertible art table of FIG. 10.
Figure 15:
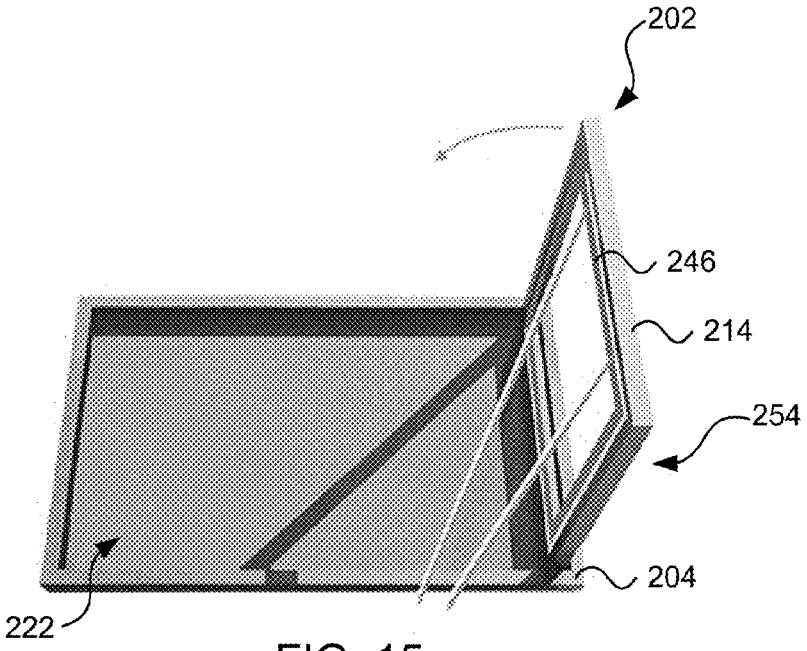
FIG. 15 illustrates the convertible art table of FIG. 14 having the base member folded into the leg member.

FIGS. 7-9 illustrate an additional embodiment of a convertible art table 102 having a variable height. The convertible art table 102 is similar to the convertible art table 2 discussed in conjunction with FIGS. 1-6, and similar description is not repeated herein. Features of the convertible art table 102 shared with the convertible art table 2 are referenced with the same reference numbers increased by 100.

In some embodiments, the first and second legs 114*a*, 114*b* of the convertible art table 102 are telescopic legs 114*a*, 114*b*. The first and second legs 114*a*, 114*b* are extendable from a first length to a second, greater length. The first and second legs 114*a*, 114*b* may be continuously extendable from the first length to the second length and/or may include one or more discrete lengths.

In some embodiments, each of the leg members 116 define an inner cavity. An extension portion 132*a*, 132*b* is sized and configured to be slideably received within the inner cavity. The extension portions 132*a*, 132*b* are deployable from a bottom opening 136 of the first and second legs 114*a*, 114*b*. The extension portions 132*a*, 132*b* are deployable from the first and second legs 114*a*, 114*b* to increase the height of the convertible art table 102 in a deployed position. For example, in some embodiments, the telescopic legs 114*a*, 114*b* allow the convertible art table 102 to extend from a first height, for example, the average height of a coffee table, to a second height, for example, corresponding to the average height of a desk.

In some embodiments, a retaining device 134 is configured to maintain the extension portions 132*a*, 132*b* at a desired extension. For example, in some embodiments, the extension portions 132*a*, 132*b* include one or more predetermined extension lengths. The retaining device 134 is configured to maintain the extension portions 132*a*, 132*b* at one of the one or more predetermined extension lengths. The retaining device 134 may comprise, for example, a push button release, a detent release, a pin, and/or any other suitable retention device. In some embodiments, the extension portions 132*a*, 132*b* are coupled to the lower cross-member 118 of the first and second legs 114*a*, 114*b*. For example, as shown in FIG. 8, when the extension portions 132*a*, 132*b* are deployed, the lower cross-member 118 moves from an initial position to an extend position (shown in phantom).

In some embodiments, each of the longitudinal members 106*a*, 106*b* and the cross-members 108*a*, 108*b* of the frame 104 may comprise an upper member 140*a* and a lower member 140*b*. Each of the upper members 140*a* and the lower members 140*b* have a predetermined thickness. In some embodiments, each of the legs 114*a*, 114*b* have the same predetermined thickness. When the first and second legs 114*a*, 114*b* are in the collapsed position, the first and second legs 114*a*, 114*b* are flush with the lower members 140*b* of the frame 104. In some embodiments, the frame 104 and/or the legs 114*a*, 114*b* may comprise any number of members, such as, for example, one, two, or multiple members.

In some embodiments, the first and second legs 114*a*, 114*b* are rotatably coupled to the lower members 140*b* of the cross-members 108*a*, 108*b* of the frame 104. For example, the first and second legs 114*a*, 114*b* may be coupled to the lower members 140*b* by one or more hinges 138. The hinges 138 have a pivot 142 that allows the first and second legs 114*a*, 114*b* to fold from the collapsed position (in which the legs 114*a*, 114*b* are located within the internal cavity defined by the frame 104) to a deployed position. The hinge 138 is movable from a first position corresponding to the legs in a collapsed position (e.g., flush with the frame 104) to a deployed position.

FIGS. 10-16 illustrate an additional embodiment of a convertible art table 202. The convertible art table 102 is similar to the convertible art table 2 discussed in conjunction with FIGS. 1-9, and similar description is not repeated herein. Features of the convertible art table 202 shared with the convertible art table 2 are referenced with the same reference numbers increased by 200.

In some embodiments, the convertible art table 202 includes a single leg portion 214. The single leg 214 includes an upper cross-member 226 coupled to the frame 204 and a base member 246 coupled to the leg portion 214. The leg portion 214 comprises first and second side members 216 coupled by a top cross-member 226 and a bottom cross-member 218. The leg portion 214 is rotatably coupled to the frame 204, for example, by a first hinge. The base portion 246 is rotatably coupled to the leg 214, for example, by a second hinge. The base portion 246 is sized and configured to be rotated, or folded, into a void defined by the leg portion 214. The base portion 246 and the leg portion 214, denoted collectively as 254, can then be folded into a void 222 defined by the frame 204 located behind the back surface of the artwork 210. In some embodiments, removable locking members 220 are configured to maintain the base portion 246 and the leg 214 in either a deployed position or a collapsed position.

Figure 16:
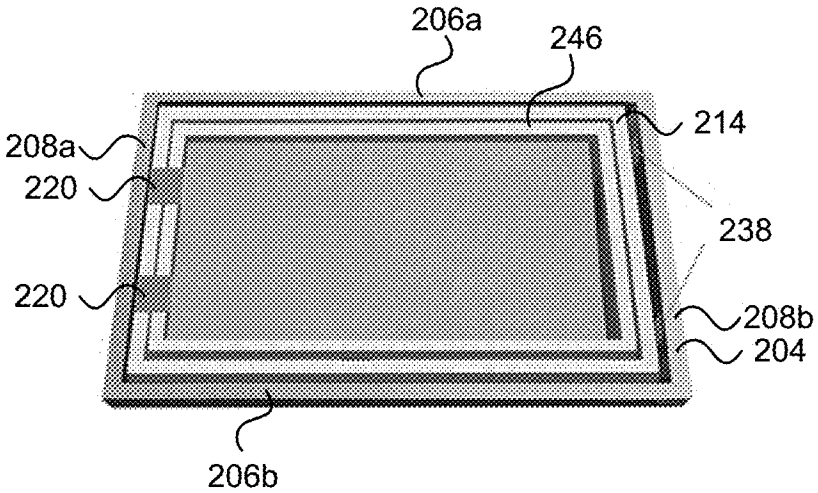
FIG. 16 illustrates the convertible art table of FIG. 14 having the leg member and the base member in a fully collapsed position.

The base portion 246 comprises a pair of longitudinal members 250 coupled by a cross-members 252. In some embodiments, the longitudinal members 250 are parallel to the longitudinal members 206*a*, 206*b* of the frame 204 when the base 246 is in a deployed position. As shown in FIG. 16, the base portion 246 and the leg portion 214 are flush with the frame 204 in a collapsed position.

In some embodiments, the artwork 10 in one or more of the embodiments described herein may be replaced with a digital display screen, such as, for example, an LCD, LED, OLED, and/or any other suitable screen. The digital display screen may be coupled to a wireless communications module. The wireless communication module may be configured for digital and/or analog transmission, such as, for example, Wi-Fi, cellular, radio frequency, etc. The digital display screen may be coupled to a memory unit and/or a processor. In some embodiments, the digital display is configured to display artwork, game boards, and/or any other suitable image.

In some embodiments, the digital display may be configured to cycle through and/or update the image displayed based on one or more algorithms. For example, in some embodiments, the digital display may be coupled to a subscription service configured to provide updated artwork and/or images based on one or more user preferences. User preferences may include, for example, specific artists, art styles, subjects, and/or any other suitable user preference.

In one embodiment, a user may purchase a subscription service to a specific artist's work. The artwork displayed on the digital display may update to display a new piece by the artist on a predetermined schedule. The changing artwork allows the user to update artwork without the need to purchase new art and/or to change out the art displayed in the convertible art table 2.

Although the subject matter has been described in terms of exemplary embodiments, it is not limited thereto. Rather, the appended claims should be construed broadly, to include other variants and embodiments, which may be made by those skilled in the art.

What is claimed is:

1. A convertible art table, comprising:

a frame, comprising:

a first longitudinal member;

a second longitudinal member;

a first transverse member coupled to a first side of the first longitudinal member and a first side of the second longitudinal member, wherein the first transverse member includes at least one wall hanging feature configured to couple the frame to a fastener coupled to a wall; and a second transverse member coupled to a second side of the first longitudinal member and a second side of the second longitudinal member, wherein the first longitudinal member, the second longitudinal member, and the first transverse member define an inner volume;

a digital display located within the inner volume; and at least a first leg member rotatably coupled to the frame, the at least first leg rotatable from a first position in which the at least first leg member is flush with or recessed below an upper edge of the frame to a second position, wherein the at least first leg member is transverse to the frame in the second position.

2. The convertible art table of claim 1, comprising a removable retaining member, wherein the removable retaining member is configured to maintain the at least first leg in the first position.

3. The convertible art table of claim 2, wherein the removable retaining member is configured to maintain the at least first leg in the second position.

4. The convertible art table of claim 2, wherein the removable retaining member comprises a locking clip.

5. The convertible art table of claim 2, wherein the first transverse member is removably coupled to the first and second longitudinal members.

6. The convertible art table of claim 1, comprising at least a second leg rotatably coupled to the frame, wherein the at least second leg rotatable from a first position in which the at least second leg member is flush with or recessed beneath an upper edge of the frame to a second position, wherein the at least second leg member is transverse to the frame in the second position.

7. The convertible art table of claim 1, wherein the first and second transverse members comprise a first length, and wherein the first and second longitudinal members comprise a second length, and wherein the first length is about half the second length.

8. The convertible art table of claim 1, comprising a wireless communication module in signal communication with the digital display, wherein the wireless communication module is configured to receive a new image to be displayed by the digital display.

9. The convertible art table of claim 8, wherein the wireless communication module is in signal communication with a subscription service, and wherein the subscription service is configured to provide one or more additional images to the digital display based on one or more user preferences.

10. The convertible art table of claim 9, wherein the one or more user preferences include at least one of an artist, an art style, a subject, or any combination thereof.

11. The convertible art table of claim 1, comprising a memory module coupled to the digital display, wherein the memory module is configured to store one or more images, and wherein a user can select one of the one or more images for display by the digital display.

12. A system, comprising:

a convertible art table, comprising:

a frame, comprising:

a first longitudinal member;

a second longitudinal member;

a first transverse member coupled to a first side of the first longitudinal member and a first side of the second longitudinal member, wherein the first transverse member includes at least one wall hanging feature configured to couple the frame to a fastener coupled to a wall; and a second transverse member coupled to a second side of the first longitudinal member and a second side of the second longitudinal member, wherein the first longitudinal member, the second longitudinal member, and the first transverse member define an inner volume;

at least a first leg member rotatably coupled to the frame, the at least first leg rotatable from a first position in which the at least first leg member is flush with or recessed below an upper edge of the frame to a second position, wherein the at least first leg member is transverse to the frame in the second position;

a digital display located within the inner volume; and a wireless communication module in signal communication with the digital display, wherein the wireless communication module is configured to receive one or more digital images from a remote subscription service, and wherein the one or more digital images are displayed on the digital display.

13. The convertible art table of claim 12, comprising a removable retaining member, wherein the removable retaining member is configured to maintain the at least first leg in the first position.

14. The convertible art table of claim 13, wherein the removable retaining member is configured to maintain the at least first leg in the second position.

15. The convertible art table of claim 13, wherein the removable retaining member comprises a locking clip.

16. The convertible art table of claim 13, wherein first transverse member is removably coupled to the first and second longitudinal members.

17. The convertible art table of claim 12, comprising at least a second leg rotatably coupled to the frame, wherein the at least second leg rotatable from a first position in which the at least second leg member is flush with or recessed below an upper edge of the frame to a second position, wherein the at least second leg member is transverse to the frame in the second position.

18. The convertible art table of claim 12, wherein the one or more additional images are selected based on one or more user preferences.

19. A convertible art table, comprising:

a frame, comprising:

a first longitudinal member;

a second longitudinal member;

a first transverse member coupled to a first side of the first longitudinal member and a first side of the second longitudinal member, wherein the first transverse member includes at least one wall hanging feature configured to couple the frame to a fastener coupled to a wall; and a second transverse member coupled to a second side of the first longitudinal member and a second side of the second longitudinal member, wherein the first longitudinal member, the second longitudinal member, and the first transverse member define an inner volume;

a digital display located within the inner volume; and a first leg rotatably coupled to the first transverse member; and a second leg rotatably coupled to the second transverse member, wherein the first and second legs are rotatable from a first position in which the first and second leg members are flush with or recessed below an upper edge of the frame to a second position, wherein the first and second leg members are transverse to the frame in the second position.

20. The convertible art table of claim 19, comprising a plurality of removable locking members, wherein the plurality of removable locking members are configured to maintain the first and second leg in the first position, and wherein the removable locking members are configured to maintain the first and second leg in the second position after the first and second leg members are rotated to the second position.

* * * * *